US010770838B2

(12) United States Patent
Miyamura et al.

(10) Patent No.: US 10,770,838 B2
(45) Date of Patent: Sep. 8, 2020

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/486,916

(22) PCT Filed: Jan. 29, 2018

(86) PCT No.: PCT/JP2018/002664
§ 371 (c)(1),
(2) Date: Aug. 19, 2019

(87) PCT Pub. No.: WO2018/150854
PCT Pub. Date: Aug. 23, 2018

(65) Prior Publication Data

US 2020/0006891 A1 Jan. 2, 2020

(30) Foreign Application Priority Data

Feb. 17, 2017 (JP) ..... 2017-027672

(51) Int. Cl.
*H01R 13/629* (2006.01)
*H01R 13/426* (2006.01)
(Continued)

(52) U.S. Cl.
CPC ..... *H01R 13/629* (2013.01); *H01R 13/426* (2013.01); *H01R 13/6463* (2013.01); *H01R 24/58* (2013.01)

(58) Field of Classification Search
CPC ..... H01R 13/5816; H01R 13/58; H01R 13/5833; H01R 13/658; H01R 13/562;
(Continued)

(56) References Cited

U.S. PATENT DOCUMENTS 6,435,732 B1 * 8/2002 Asao ..... G02B 6/387 385/78
8,771,016 B2 * 7/2014 Atkinson ..... H01R 13/6598 439/607.07
(Continued)

FOREIGN PATENT DOCUMENTS

JP 5-230197 9/1993
JP 2597502 4/1997
(Continued)

OTHER PUBLICATIONS

International Search Report dated Feb. 27, 2018.

*Primary Examiner* — Hien D Vu
(74) *Attorney, Agent, or Firm* — Gerald E. Hespos; Michael J. Porco; Matthew T. Hespos

(57) ABSTRACT

A connector (1) includes a dielectric (10) having conductor accommodation chambers (17) laterally partitioned by a separation wall (15), inner conductors (36) individually accommodated in the conductor accommodation chambers (17), a body (11) made of synthetic resin, constituting the dielectric (10) and formed with the separation wall (15) and the conductor accommodation chambers (17), and a front wall (28) made of synthetic resin, constituting the dielectric (10) and mounted on a front part of the body (11) to close front end openings of the conductor accommodation chambers (17). The separation wall (15) is made of a material
(Continued)

having a lower dielectric constant than the front wall (28), and the front wall (28) is made of a material having a higher mechanical strength than the separation wall (15).

5 Claims, 17 Drawing Sheets

(51) Int. Cl.
*H01R 13/6463* (2011.01)
*H01R 24/58* (2011.01)

(58) Field of Classification Search
CPC .. H01R 13/514; H01R 13/518; H01R 13/629; H01R 13/426; H01R 13/6463
USPC ..... 439/455, 456, 731, 701
See application file for complete search history.

(56) References Cited

U.S. PATENT DOCUMENTS

| | | | | |
|---|---|---|---|---|
| 8,814,595 | B2 * | 8/2014 | Cohen | H01R 13/6461 439/607.07 |
| 8,926,368 | B2 * | 1/2015 | Il | H01R 13/658 439/607.5 |
| 2018/0138640 | A1 * | 5/2018 | Maesoba | H01R 13/6581 |

FOREIGN PATENT DOCUMENTS

| | | |
|---|---|---|
| JP | 10-275648 | 10/1998 |
| JP | 2000-67986 | 3/2000 |
| JP | 2011-54521 | 3/2011 |
| JP | 2012-129103 | 7/2012 |
| JP | 2015-37007 | 2/2015 |
| JP | 5729350 | 6/2015 |

* cited by examiner

CONNECTOR

BACKGROUND

Field of the Invention

The invention relates to a connector.

Related Art

Japanese Unexamined Patent Publication No. 2012-129103 discloses a connector that has a male inner conductor mounted in a male dielectric and a female inner conductor mounted in a female dielectric. The male and female inner conductors are connected be fitting the male and female dielectrics together.

A connector of this type also may have a female dielectric with plural conductor accommodation chambers partitioned by separation walls and female inner conductors are accommodated individually into the conductor accommodation chambers. A connector of this type that is applied to a communication circuit preferably forms the female dielectric from a synthetic resin material having a low dielectric constant to guarantee communication performance. However, the synthetic resin material having a low dielectric constant is relatively low in strength. Thus, when elongated tabs on tips of male inner conductors interfere with the front surface of the female dielectric in the process of fitting both male and female dielectrics, the tabs may be pierced into the front surface of the female dielectric.

The invention was completed on the basis of the above situation and aims to combine an improvement of communication performance and a reliability improvement of a connecting operation.

SUMMARY

The invention is directed to a connector with a dielectric including conductor accommodation chambers laterally partitioned by a separation wall portion, and inner conductors are accommodated individually in the conductor accommodation chambers. The dielectric has a body made of synthetic resin. The body is formed with the separation wall portion and the conductor accommodation chambers. The dielectric also has a front wall made of synthetic resin and mounted on a front end part of the body to close front openings of the conductor accommodation chambers. Tab insertion openings are formed in the front wall to allow tabs of mating inner conductors to be inserted into the conductor accommodation chambers from the front of the dielectric. The separation wall portion is made of a material having a lower dielectric constant than the front wall, and the front wall is made of a material having a higher mechanical strength than the separation wall portion.

The separation wall portion is interposed between the inner conductors and is made of the material having a relatively low dielectric constant. Thus, the communication performance of electrical signals passing through the inner conductors is guaranteed. Further, the front wall is made of the material having a higher mechanical strength than the separation wall portion. Thus, even if the tabs of the mating inner conductors interfere with the front wall, there is no possibility that the tabs will pierce the front wall.

The dielectric may include a holding member and a lid. The holding member may be formed with the separation wall portion and grooves constituting the conductor accommodation chambers. The lid is mounted on the holding member to close openings of the grooves. According to this configuration, the inner conductors need not be inserted into the conductor accommodation chambers from behind the dielectric, and untwisted lengths of wires can be shortened when the wires connected to rear end parts of the inner conductors constitute a twisted pair cable.

The front wall may be formed with a positioning portion capable of positioning front end parts of the inner conductors. According to this configuration, the inner conductors can be accommodated into the grooves by one action by integrating the inner conductors with the front wall with the inner conductors positioned by the positioning portion.

The front wall and the holding member may be formed with fitting portions for holding the front wall member and the holding member in an assembled state by being fit to each other. The front wall may be formed with a pressing portion for holding the lid in a state assembled with the holding member by being held in contact with the lid with the front wall assembled with the holding member. According to this configuration, the lid and the holding member reliably are held in the assembled state.

DETAILED DESCRIPTION

Figure 1:
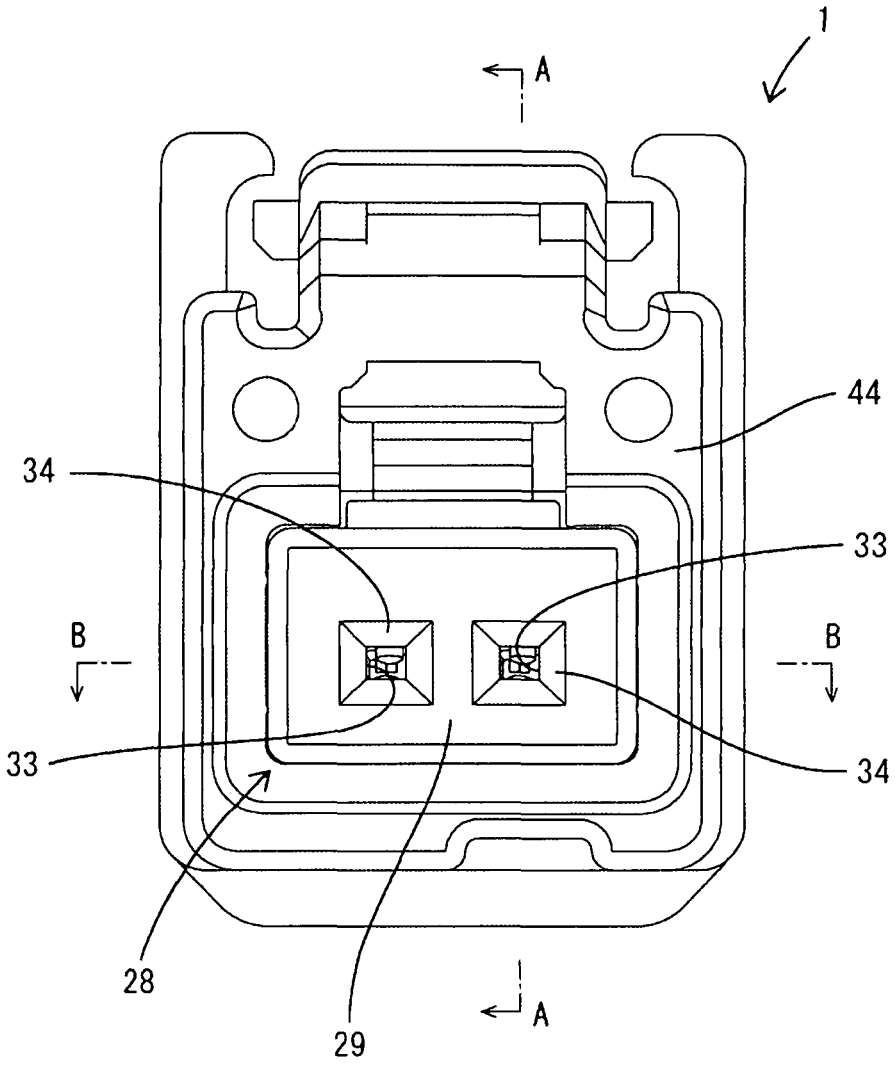
FIG. 1 is a front view of a connector of a first embodiment.
Figure 2:
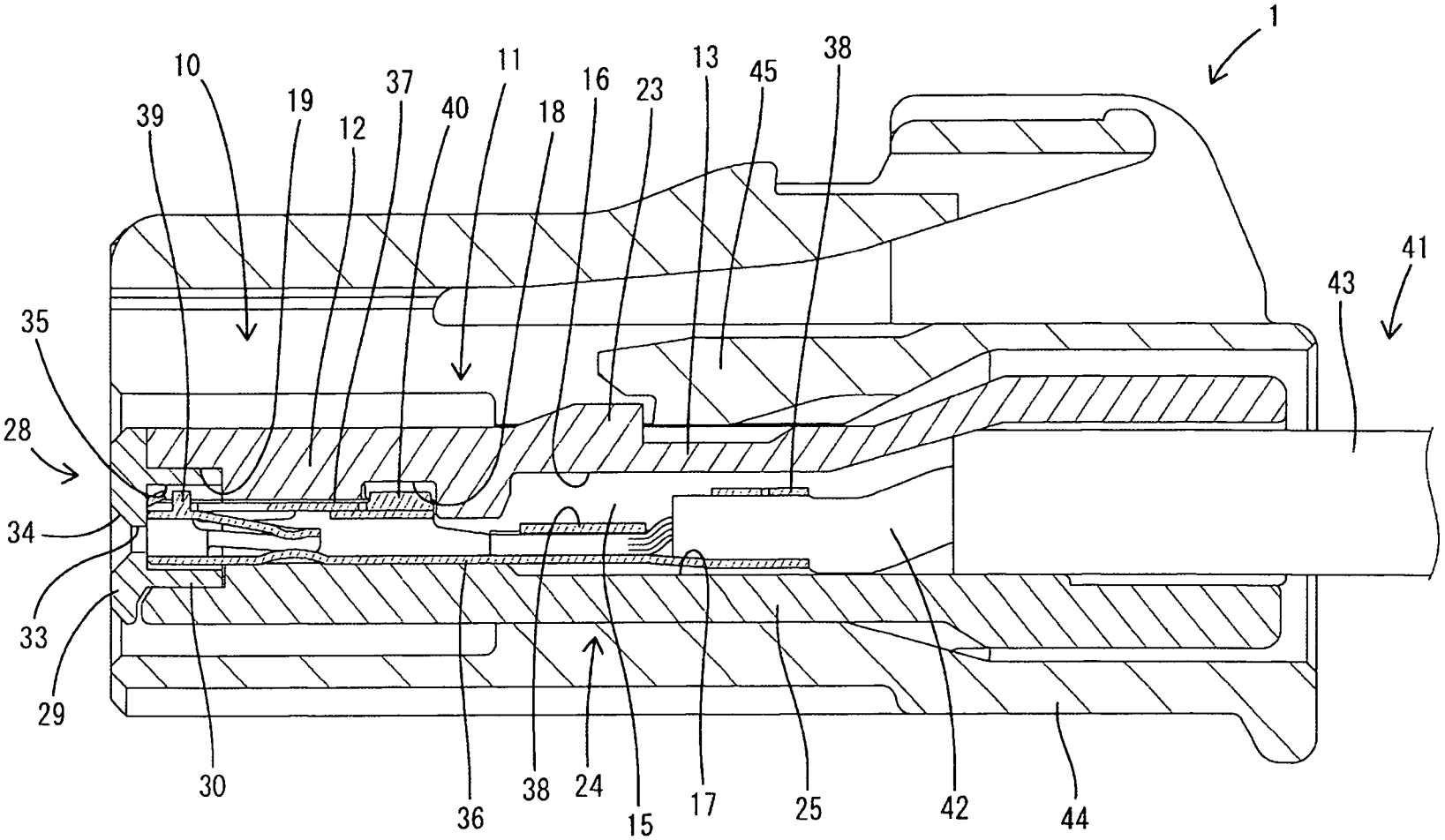
FIG. 2 is a section along A-A of FIG. 1.
Figure 3:
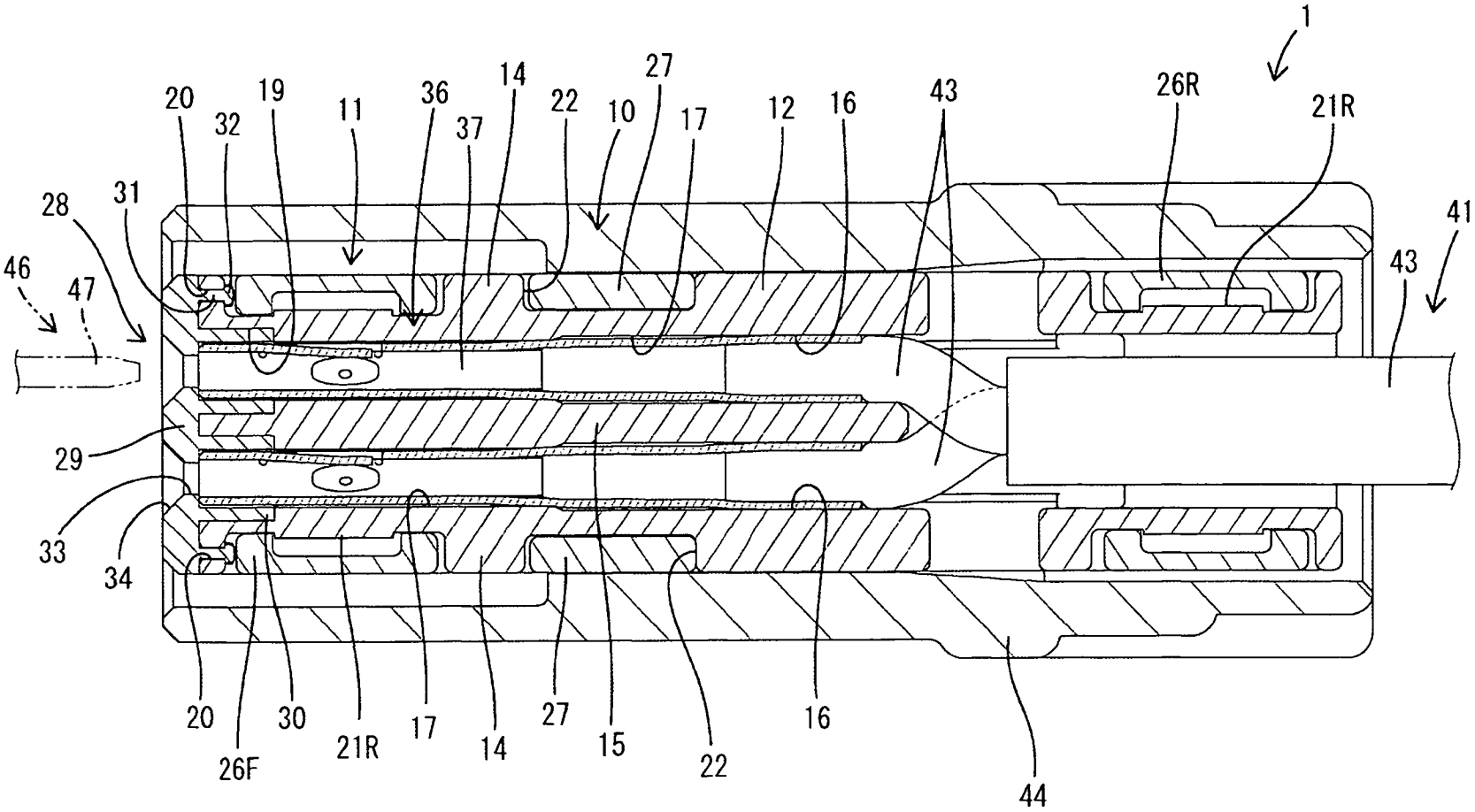
FIG. 3 is a section along B-B of FIG. 1.
Figure 4:
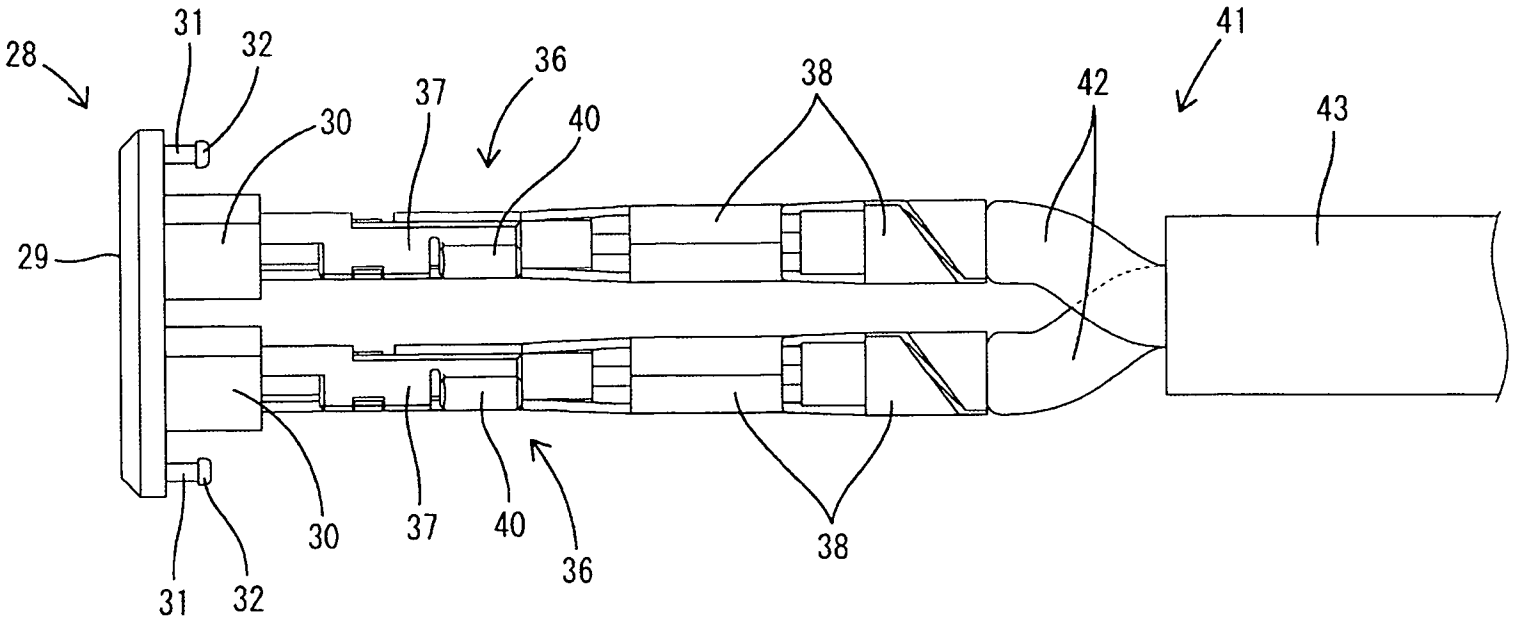
FIG. 4 is a plan view in a state where two inner conductors are positioned in a front wall member.

A first embodiment of the invention is described with reference to FIGS. 1 to 10. Note that, in the following description, a left side in FIGS. 2 to 7 is defined as a front side concerning a front-rear direction. Upper and lower sides shown in FIGS. 1, 2, 5 and 7 to 10 are directly defined as upper and lower sides concerning a vertical direction.

A connector 1 of the first embodiment includes a dielectric 10 made of synthetic resin, inner conductors 36 and a housing 44 made of synthetic resin. The dielectric 10 includes a body 11 internally formed with left and right conductor accommodation chambers 17 and a front wall 28 to be assembled with a front part of the body 11. The body 11 is configured by assembling a holding member 12 and a lid 24.

Figure 5:
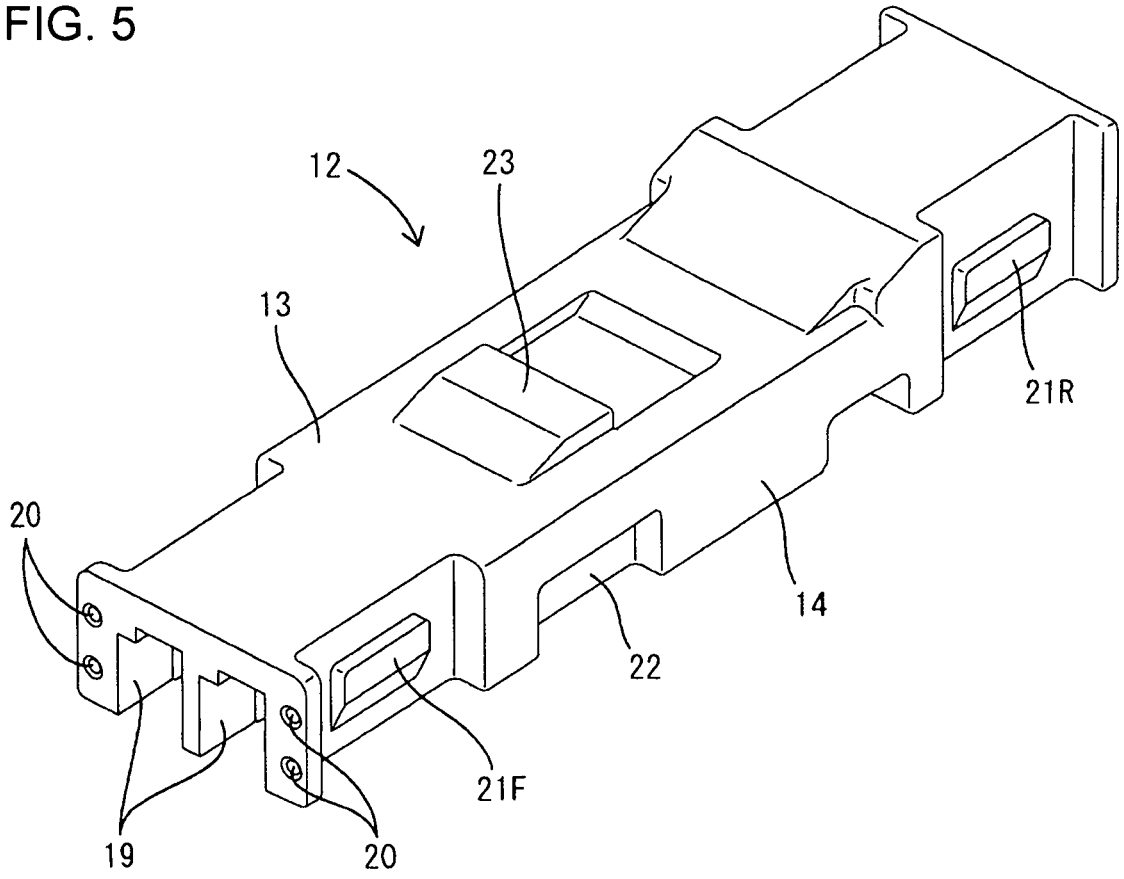
FIG. 5 is a perspective view of a holding member.
Figure 6:
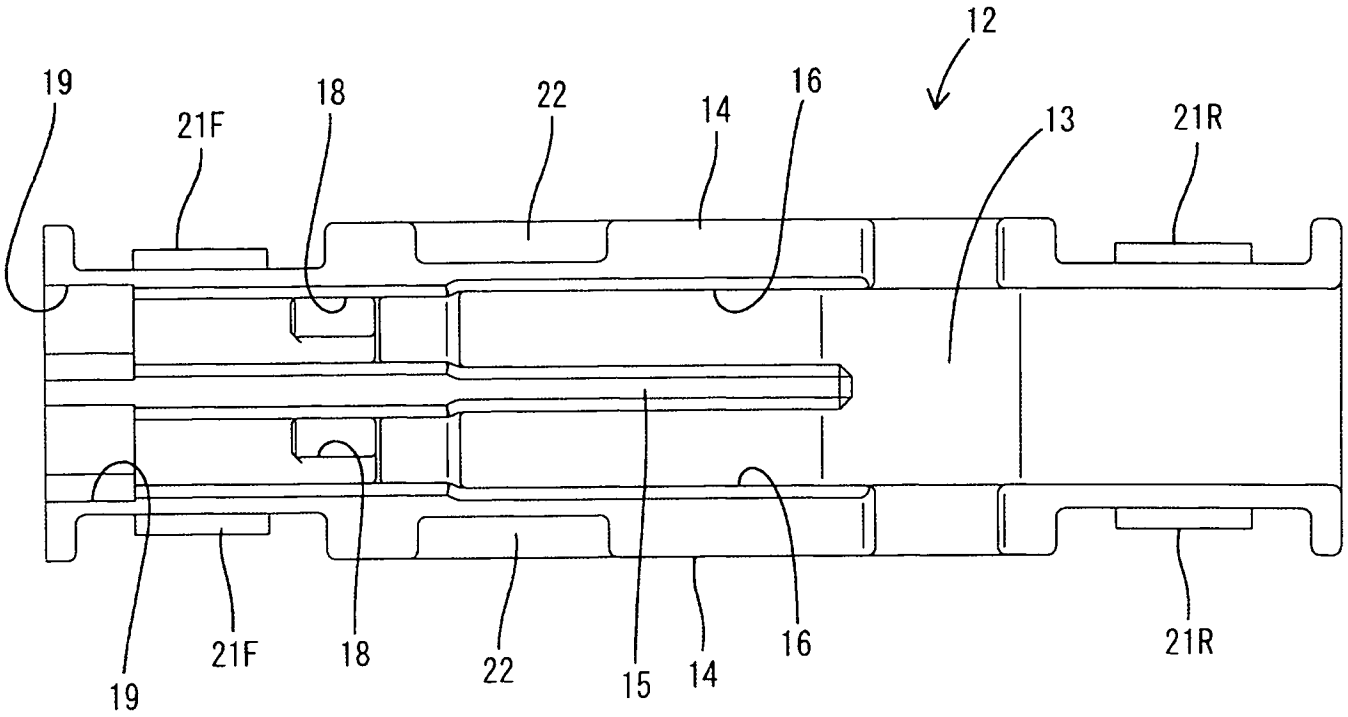
FIG. 6 is a bottom view of the holding member.

As shown in FIGS. 5 and 6, the holding member 12 is long and narrow in the front-rear direction. The holding member 12 includes an upper wall 13 long in the front-rear direction, two side walls 14 extending down substantially at right angles from left and right sides of the upper wall 13 over the entire lengths thereof, and a separation wall 15 extending down from a center of the upper wall 13 in a lateral direction (width direction) substantially at a right angle over the entire length thereof.

Spaces enclosed by the upper wall 13 and the side walls 14 of the holding member 12 serve grooves 16 laterally partitioned by the separation wall 15. Each groove 16 constitutes the conductor accommodation chamber 17. Each groove 16 is elongated in the front-rear direction and is open in the lower surface of the holding member 12 over the entire length thereof. A retaining recess 18 is formed in the inner upper surface of each groove 16. The front end of each groove 16 is open in the front surface of the holding member 12. A front part of each groove 16 is formed with an escaping recess 19 formed by partially cutting the upper wall 13, the side wall 14 and the separation wall 15 and is open in the front end surface of the holding member 12. The rear end of the groove 16 is open in the rear surface of the holding member 12.

Two vertically spaced fitting holes 20 are formed on the front end surface of each of the left and right side walls 14. Two front lock projections 21F are formed on front end parts of outer side surfaces of the left and right side walls 14, and two rear lock projections 21R are formed on rear end parts of the outer side surfaces of the left and right side walls 14. Further, positioning recesses 22 are disposed between the front and rear lock projections 21F and 21R are formed respectively in the outer surfaces of the both left and right side walls 14. A locking projection 23 is formed on an outer surface (upper surface) of the upper wall 13.

Figure 7:
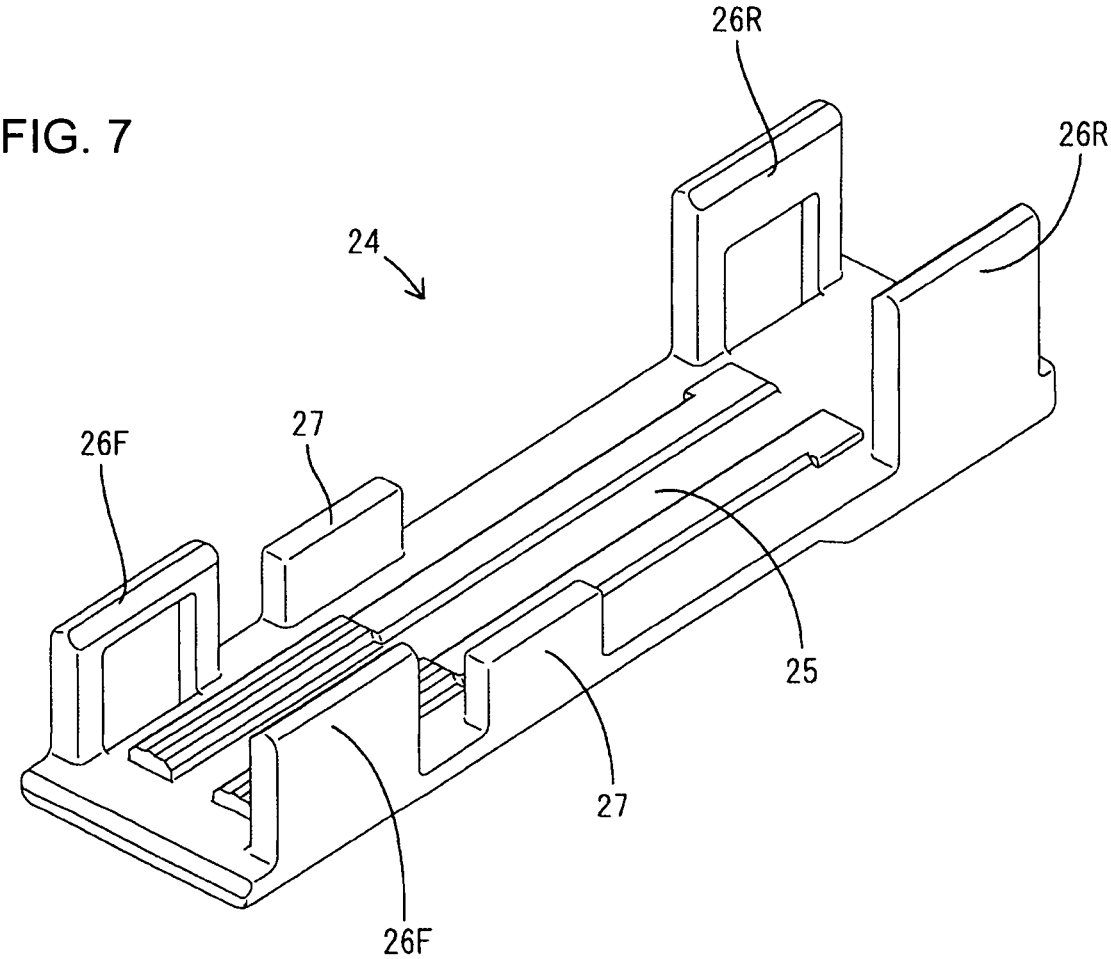
FIG. 7 is a perspective view of a lid member.
Figure 8:
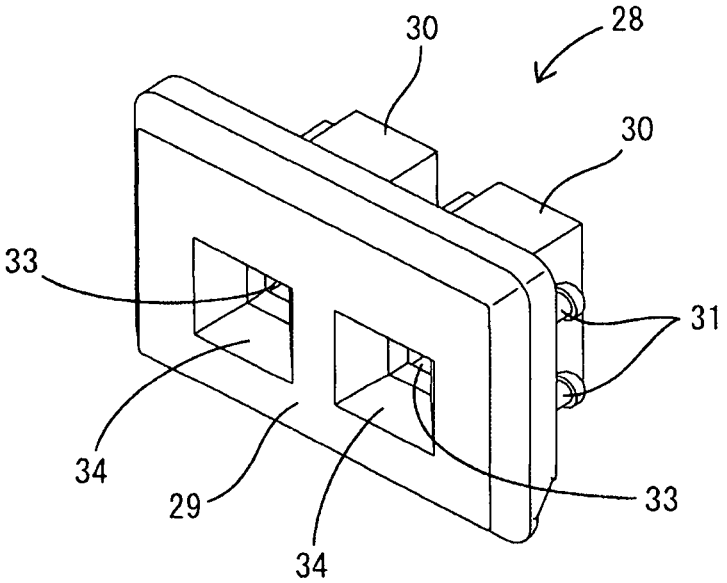
FIG. 8 is a perspective view of the front wall member.

As shown in FIG. 7, the lid 24 is long and narrow in the front-rear direction. The lid 24 is a single component including a lower wall 25 long in the front-rear direction, two front resilient lock pieces 26F extending up substantially at a right angle from front end parts of both left and right side edges of the lower wall 25 and two rear resilient lock pieces 26R extending up substantially at a right angle from rear end parts of the left and right side edges of the lower wall 25. Left and right positioning protrusions 27 are disposed between the front and rear resilient lock pieces 26F, 26R on the left and right side edges of the lower wall 25.

The lid 24 is assembled with the holding member 12 to close the lower surface (surface in which the groove portions 16 are open over the entire length areas from the front ends to the rear ends) of the holding member 12. In an assembled state, the lower wall 25 is in contact with the lower end surfaces of the left and right side walls 14 and the lower end surface of the separation wall 15 to position the holding member 12 and the lid 24 vertically. Further, the front lock projections 21F and the front resilient lock pieces 26F are locked and the rear lock projections 21R and the rear resilient lock pieces 26R are locked to restrict vertical separation and lateral relative displacements of the holding member 12 and the lid 24. Further, the positioning recesses 22 and the positioning protrusions 27 are fit to restrict relative displacements of the holding member 12 and the lid 24 in the front-rear direction.

In the above way, the holding member 12 and the lid 24 are held in a state vertically united and mounted. By uniting the holding member 12 and the lid 24, the conductor accommodation chambers 17 are formed inside the body 11 by the grooves 16 and the lower wall 25. In other words, each conductor accommodation chamber 17 is a space enclosed by the upper wall 13, one side wall 14, the separation wall 15 and the lower wall 25. Further, the conductor accommodation chambers 17 are partitioned in an insulated state by the separation wall 15. The front end of the conductor accommodation chamber 17 is open in the front surface of the body 11 and the rear end thereof is open in the rear surface of the body 11.

The front wall 28 is a single component including a wall body 29 and left and right positioning portions 30 projecting rearward from the rear surface of the wall body 29. Upper and lower fitting projections 31 are cantilevered rearward from left and right end parts of the rear surface of the wall body 29. A diameter enlarged portion 32 is formed on a projecting end (rear end part) of each fitting projection 31.

Left and right tab insertion openings 33 having square cross-sections penetrate through the wall body 29 in the front-rear direction (wall thickness direction of the wall body 29). Elongated tabs 47 on tips of mating inner conductors 46 are inserted into the tab insertion openings 33. Left and right guiding surfaces 34 are formed in the front surface of the wall body 29. Each guiding surface 34 is formed by tapering a square frame-like area along a hole edge of each tab insertion opening 33 in the front surface of the wall body 29. If the tab 47 comes into contact with the guiding surface 34, the tab 47 is guided into the tab insertion opening 33 by the inclination of the guiding surface 34.

Figure 9:
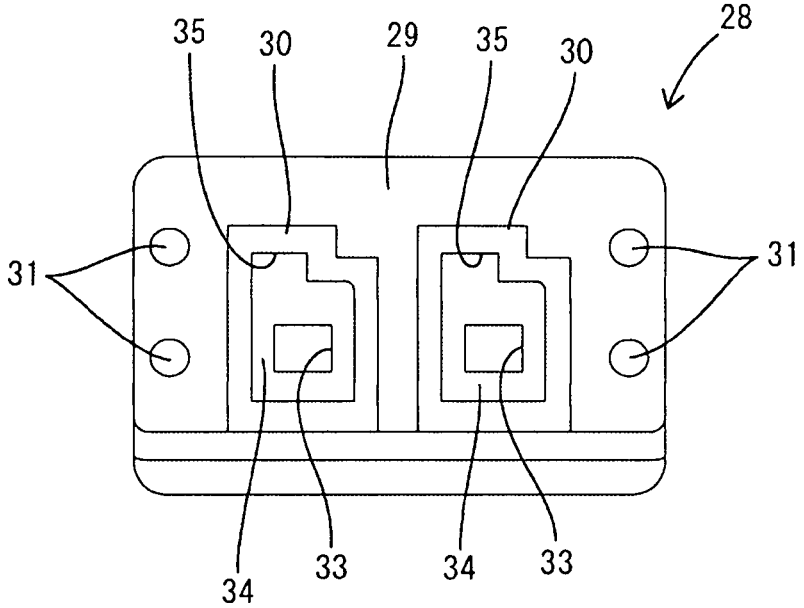
FIG. 9 is a back view of the front wall member.
Figure 10:
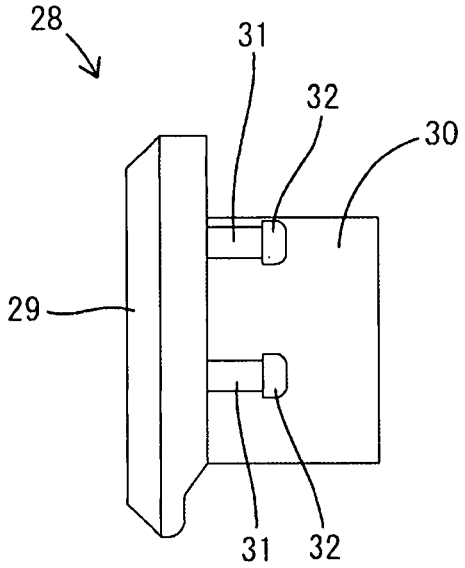
FIG. 10 is a side view of the front wall member.
Figure 11:
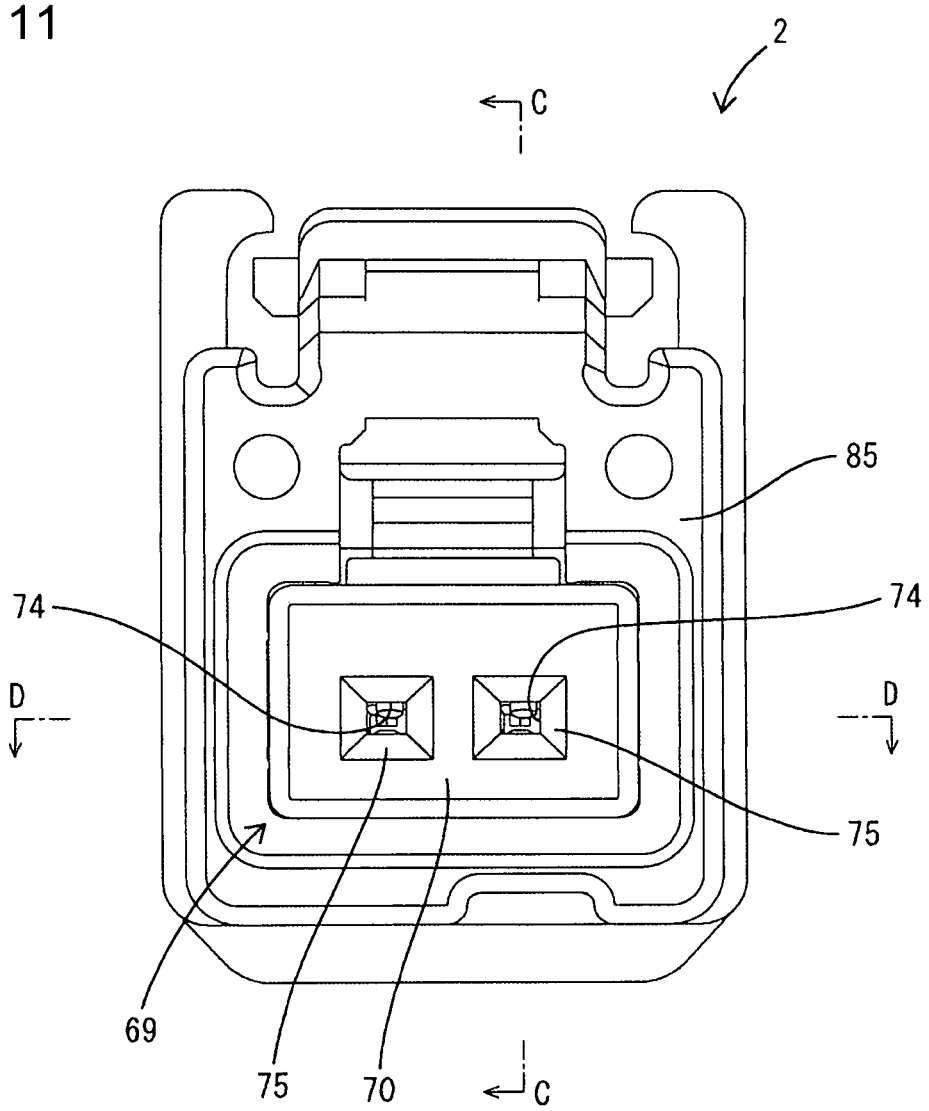
FIG. 11 is a front view of a connector of a second embodiment.
Figure 12:
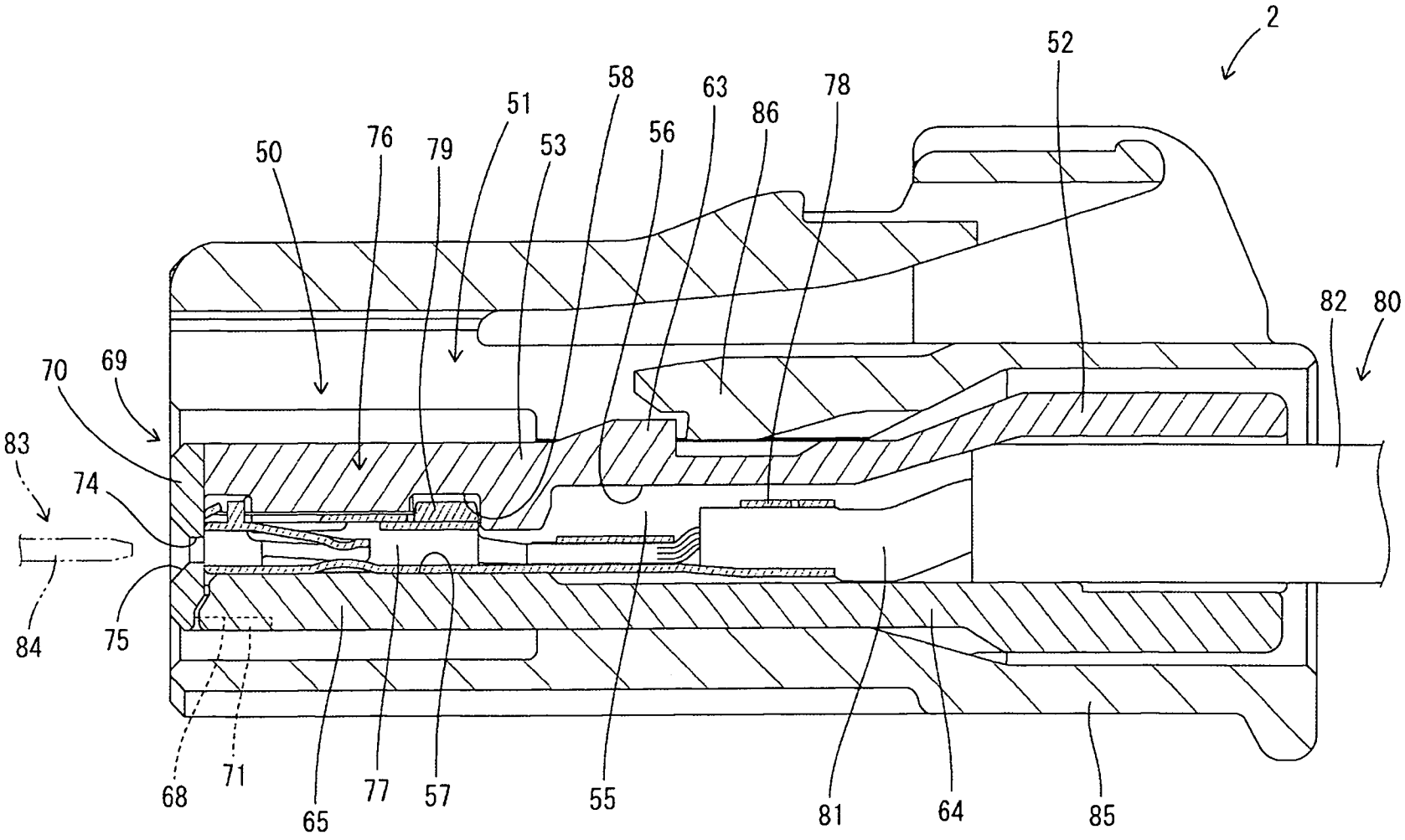
FIG. 12 is a section along C-C of FIG. 11.
Figure 13:
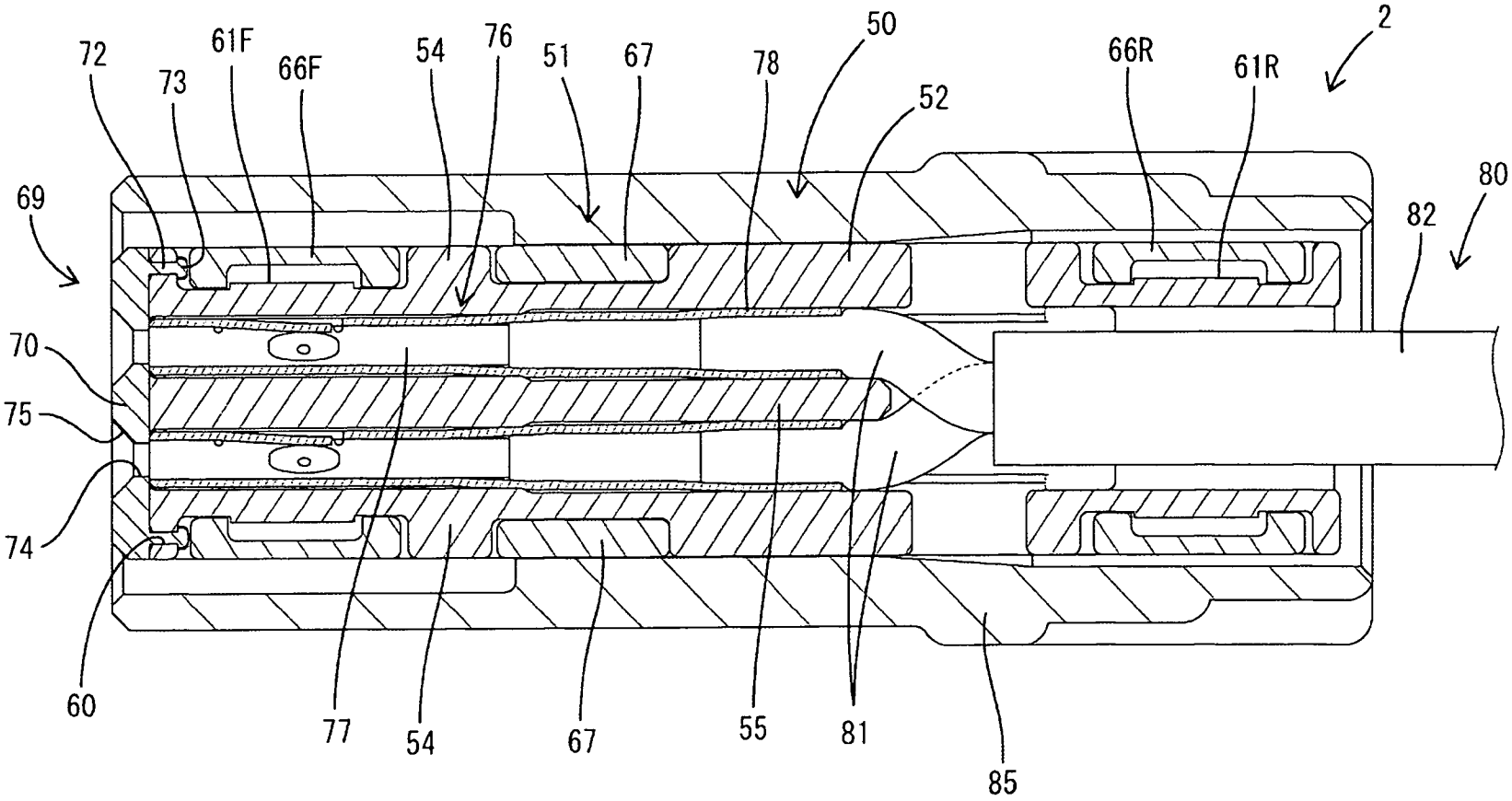
FIG. 13 is a section along D-D of FIG. 11.

Each positioning portion 30 is in the form of a rectangular tube cantilevered rearward from the rear surface of the wall body 29. A back view shape of the positioning portion 30 is rectangular, as shown in FIG. 9, and an erroneous fitting restricting recess 35 recessed upward is formed in a right side part of an upper end part. The tab insertion opening 33 is open in a front of each positioning portion 30. The inside of the positioning portion 30 is open rearward.

The front wall 28 is mounted on the front surface of the body member 11. The dielectric is configured by assembling the front wall 28 with the body 11. The front wall 28 and the body 11 are locked in an assembled state by press-fitting the fitting projections 31 into the fitting holes 20 and locking the diameter enlarged portions 32 on the tips of the fitting projections 31 to hole edge parts of the fitting holes 20 on the rear surface.

The inner conductor 36 is formed by applying bending and the like to a metal plate material, and is elongated in the front-rear direction as a whole. A rectangular tubular conductor body 37 is formed in a front end area of the inner conductor 36, and a crimping portion 38 in the form of an open barrel is formed in a rear end area of the inner conductor 36. A front part of the conductor body portion 37 is formed with a stabilizer 39 (see FIG. 2) projecting up from the upper surface thereof. A rear end part of the conductor body 37 is formed with a retaining projection 40 projecting up from the upper surface thereof.

Front end parts of two wires 42 are connected individually and conductively to the two inner conductors 36. In particular, the front part of the wire 42 is crimped conductively and substantially coaxially to each crimping portion 38. The two wires 42 constitute a twisted pair cable 41 by being spirally twisted each other. The twisted pair cable 41 is integrated while being collectively enclosed by a tubular insulating member 43 and constitutes a signal circuit.

The front end part of the inner conductor 36 is fit into each positioning portion 30 from behind the front wall 28. The inner conductor 36 fit in the positioning portion 30 is positioned with relative displacements in the vertical and lateral directions restricted with respect to the front wall 28. Further, the stabilizer 39 is accommodated into the erroneous fitting restricting recess 35.

Accordingly, if it is attempted to fit the inner conductor 36 in a vertical inverted orientation into the positioning portion 30, the stabilizer 39 interferes with the rear end edge of a lower end part of the positioning portion 30 so that the inner conductor 36 is prevented from being fit in a wrong vertically inverted orientation into the positioning portion 30 (front wall 28).

Each inner conductor 36 is accommodated into the conductor accommodation chamber 17. The inner conductor 36 accommodated in the conductor accommodation chamber 17 is in contact with the upper wall 13, the lower wall 25, the side wall 14 and the separation wall 15, thereby being held with relative displacements in the vertical and lateral directions restricted with respect to the conductor accommodation chamber 17 (dielectric 10). Further, by fitting the retaining projection 40 and the retaining recess 18, the inner conductor 36 is held with relative displacements in the front-rear direction restricted with respect to the conductor accommodation chamber 17 (dielectric 10).

The dielectric 10 is configured by assembling three components, i.e. the holding member 12, the lid 24 and the front wall 28. Polypropylene (PP) is used as a material of the holding member 12. A material of the lid 24 is also polypropylene. That is, the holding member 12 and the lid 24 constituting the body member 11 are made of the same material. On the other hand, polybutylene terephthalate (PBT), which is synthetic resin having a relatively high mechanical strength, is used as a material of the front wall 28 constituting a front surface part of the dielectric 10.

Polybutylene as the material of the body 11 has a lower mechanical strength and a lower dielectric constant (relative dielectric constant) than polypropylene terephthalate. In selecting the material of the body 11, it is considered that the inner conductors 36 constitute the signal circuit and the holding member 12 is formed integrally with the separation wall portion 15 partitioning between the two inner conductors 36. Thus, polypropylene, which is synthetic resin less affecting signal transmission, i.e. having a relatively low dielectric constant (relative dielectric constant), is selected as the material of the body 11.

On the other hand, in selecting the material of the front wall 28, a possibility that the tabs 47 are pierced into the guiding surfaces 34 in the front surface of the front wall 28 due to tolerances and the like is considered since the elongated tabs 47 of the mating inner conductors 46 are inserted into the tab insertion openings 33 from the front of the dielectric 10. Thus, polybutylene having such a mechanical strength as not to be pierced by the tabs 47 is selected as the material of the front wall 28.

Next, an assembling procedure of the connector 1 of the first embodiment is described. The front part of the wire 42 is crimped to the rear part of each inner conductor 36. The two inner conductors 36 having the wires 42 crimped thereto are fit individually into the left and right positioning portions 30 of the front wall 28, thereby being positioned in the vertical and lateral directions with respect to the front wall 28. Thereafter, the front wall 28 and the two inner conductors 36 are set in the vertically inverted holding member 12.

At this time, each inner conductor 36 is accommodated into the respective groove 16 with the front wall 28 located slightly before a proper mounting position. Since a mounting direction of the inner conductor 36 into the groove 16 at this time is substantially at a right angle to axial directions of the inner conductor 36 and the wire 42 (front-rear direction), a length of an area of the front end part of each of the two wires 42 exposed from the front end of the insulating member 43 and untwisted can be shorter as compared to the case where the inner conductors 36 are inserted into the grooves 16 (conductor accommodation chambers 17) from behind. Thus, an electromagnetic shielding function as the twisted pair cable 41 is excellent.

The wall body 29 is separated forward of the holding member 12 with the front wall 28 and the inner conductors 36 integrally set in the holding member 12. Thus, the positions of the inner conductors 36 also are displaced forward from proper mounting positions. To correct these displacements, the inner conductors 36 are moved rearward together with the front wall 28 and the rear surface of the wall body 29 is brought into contact with the front surface of the holding member 12. At this time, the fitting projections 31 of the front wall 28 are press-fit into the fitting holes 20 of the holding member 12 and the diameter enlarged portions 32 of the fitting projections 31 are locked to the holding member 12. In the above way, the front wall 28 is assembled properly with the holding member 12 and the inner conductors 36 are accommodated at proper positions in the grooves 16.

With the inner conductors 36 properly accommodated in the grooves 16, the retaining projections 40 are locked into the retaining recesses 18 so that the inner conductors 36 are held so that displacements in the front-rear direction are restricted with respect to the holding member 12 (grooves 16). Further, the positioning portions 30 are fit into the escaping recesses 19 of the holding member 12. In the above way, the front wall 28 and the two inner conductors 36 are integrated with the holding member 12.

Thereafter, the lid 24 is brought vertically closer to the holding member 12 and united. With the holding member 12 and the lid 24 united, the front resilient lock pieces 16F and the front lock projections 21F are locked, the rear resilient lock pieces 26R and the rear lock projections 21R are locked and the positioning recesses 22 and the positioning protrusions 27 are locked to unite the holding member 12 and the lid. In the above way, the two inner conductors 36 are accommodated in the dielectric 10 at the same time as the assembling of the dielectric 10 is completed. The dielectric 10 having the inner conductors 36 mounted therein is inserted into the housing 44 and locked in a retained state by the locking of locking lances 45 and the locking projection 23.

The connector 1 of the first embodiment is designed for combining an improvement of communication performance and a reliability improvement of a connecting operation, and includes the dielectric 10 and the inner conductors 36. The dielectric 10 includes two conductor accommodation chambers 17 laterally partitioned by the separation wall 15, and the two inner conductors 36 are accommodated individually into the two conductor accommodation chambers 17.

The dielectric 10 includes the body 11 made of synthetic resin and formed with the separation wall 15 and the two conductor accommodation chambers 17, and the front wall 28 made of synthetic resin and mounted on the front part of the body 11 to close front end openings of the conductor accommodation chambers 17. The front wall 28 is formed with the tab insertion openings 33 allowing the tabs 47 of the mating inner conductors 46 to be inserted into the conductor accommodation chambers 17 from the front of the dielectric 10.

The separation wall 15 is made of the synthetic resin material (polypropylene) having a lower dielectric constant than the front wall 28. The front wall 28 is made of the material (polybutylene terephthalate) having a higher mechanical strength than the separation wall 15. In the connector of the first embodiment, the separation wall 15 is interposed between the two inner conductors 36 and is made of the material having a relatively low dielectric constant. Thus, the communication performance of electrical signals passing through the inner conductors 36 is guaranteed. Further, the front wall 28 is made of the material having a higher mechanical strength than the separation wall 15. Thus, even if the tabs 47 of the mating inner conductors 46 interfere with the front wall 28, there is no possibility that the tabs 47 are pierced into the front wall 28.

Further, the two wires 42 connected to the rear end parts of the inner conductors 36 constitute the twisted pair cable 41. Thus, in the case of inserting the inner conductors 36 connected to the respective wires 42 into the conductor accommodation chambers 17 from behind the body 11, untwisted lengths of the wires 42 need to be increased. However, in the first embodiment, the dielectric 10 is divided into the holding member 12 and the lid 24, and the holding member 12 is formed with the separation wall 15 and the two grooves 16 constituting the two conductor accommodation chambers 17. The lid 24 is mounted on the holding member 12 to close openings of the two groove portions 16. A mounting direction of the lid 24 and the holding member 12 is the vertical direction intersecting length directions of the inner conductors 36 and the wires 42. According to this configuration, it is not necessary to insert the two inner conductors 36 into the conductor accommodation chambers 17 from behind the dielectric 10. Consequently, the untwisted lengths of the wires 42 can be shortened, and reduction of the shielding function of the twisted pair cable 41 can be avoided.

Further, the front wall 28 is formed with the positioning portions 30 capable of positioning the front end parts of the two inner conductors 36. According to this configuration, the two inner conductors 36 can be accommodated into the two grooves 16 in one action by integrating the two inner conductors 36 with the front wall 28 with the two inner conductors 36 positioned by the positioning portions 30.

Second Embodiment

A second embodiment of the present invention is described with reference to FIGS. 11 to 21. Note that, in the following description, a left side in FIGS. 12 to 17 is defined as a front side concerning a front-rear direction. Upper and lower sides shown in FIGS. 11, 12, 14, 16 and 18 to 20 are defined as upper and lower sides concerning a vertical direction.]

A connector 2 of the second embodiment includes a dielectric 50 made of synthetic resin, inner conductors 76 and a housing 85 made of synthetic resin. The dielectric 50 includes a body 51 internally formed with left and right conductor accommodation chambers 57 and a front wall 69 to be assembled with a front end part of the body 51. The body 51 is configured by assembling a holding member 52 and a lid 64.

Figure 14:
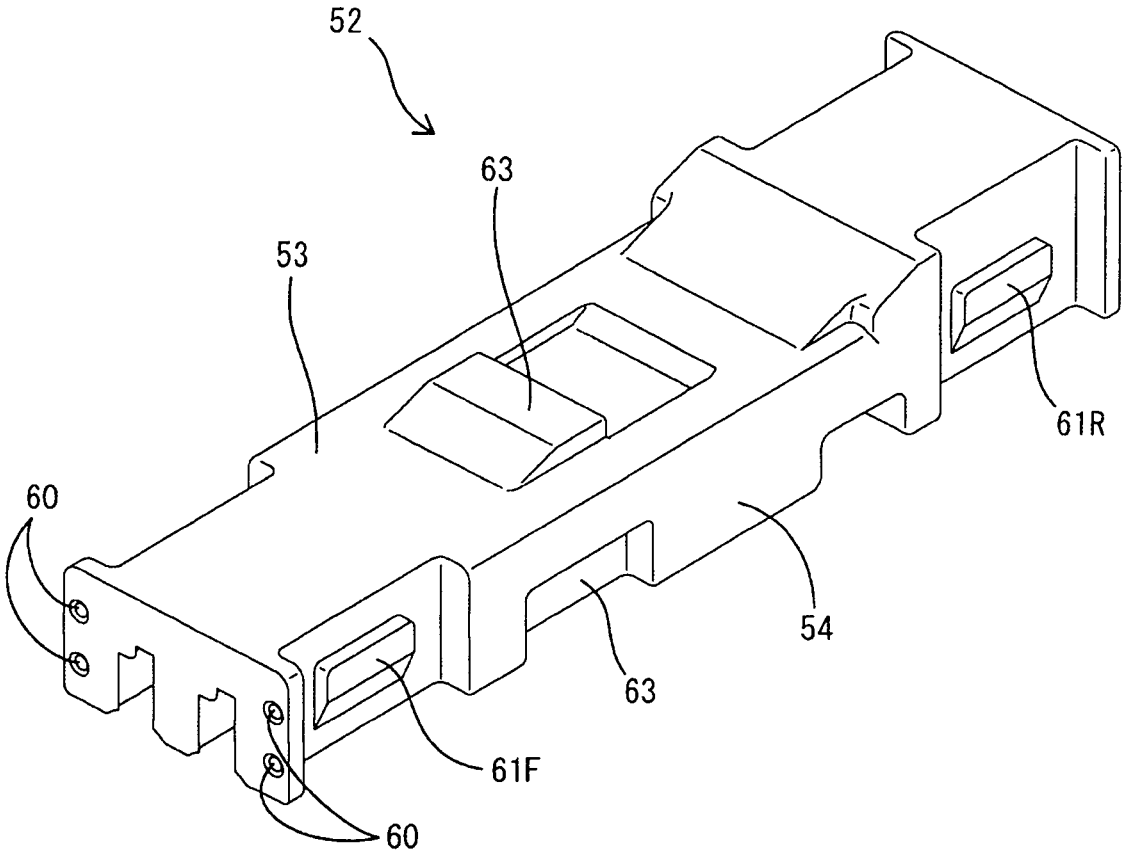
FIG. 14 is a perspective view of a holding member.
Figure 15:
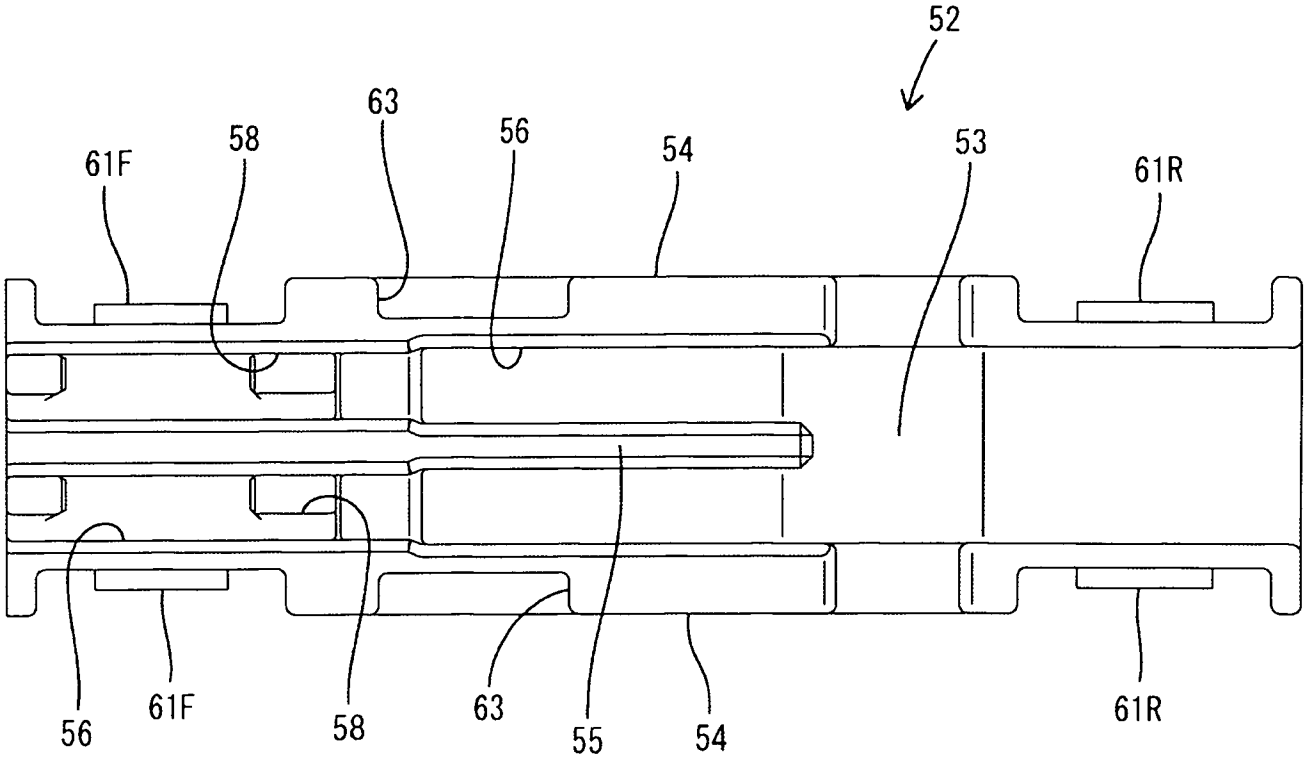
FIG. 15 is a bottom view of the holding member.

As shown in FIGS. 14 and 15, the holding member 52 is long and narrow in the front-rear direction. The holding member 52 includes an upper wall 53 long in the front-rear direction, two side walls 54 extending down substantially at a right angle from both left and right side edges of the upper wall 53 over the entire lengths thereof, and a separation wall 55 extending down from a center of the upper wall 53 in a lateral direction (width direction) substantially at a right angle over the entire length thereof.

Spaces enclosed by the upper wall 53 and the side walls 54 of the holding member 52 serve as grooves 56 laterally partitioned by the separation wall 55. Each groove 56 constitutes the conductor accommodation chamber 57. Each groove 56 is elongated in the front-rear direction and is open in the lower surface of the holding member 52 over the entire length thereof. A retaining recess 58 is formed in the inner upper surface of each groove 56. The front end of the groove 56 is open in the front surface of the holding member 52, and the rear end of the groove portion 56 is open in the rear surface of the holding member 52.

Two vertically spaced fitting holes 60 (fitting portions as claimed) are formed on the front end surface of each of the left and right side walls 54. Two front lock projections 61F are formed on front end parts of outer side surfaces of the left and right side walls 54, and two rear lock projections 61R are formed on rear end parts of the outer side surfaces of the left and right side walls 54. Further, positioning recesses 62 are formed in the outer surfaces of the left and right side walls 54 at positions between the front and rear lock projections 61F and 61R. A locking projection 63 is formed on an outer surface (upper surface) of the upper wall 53.

Figure 16:
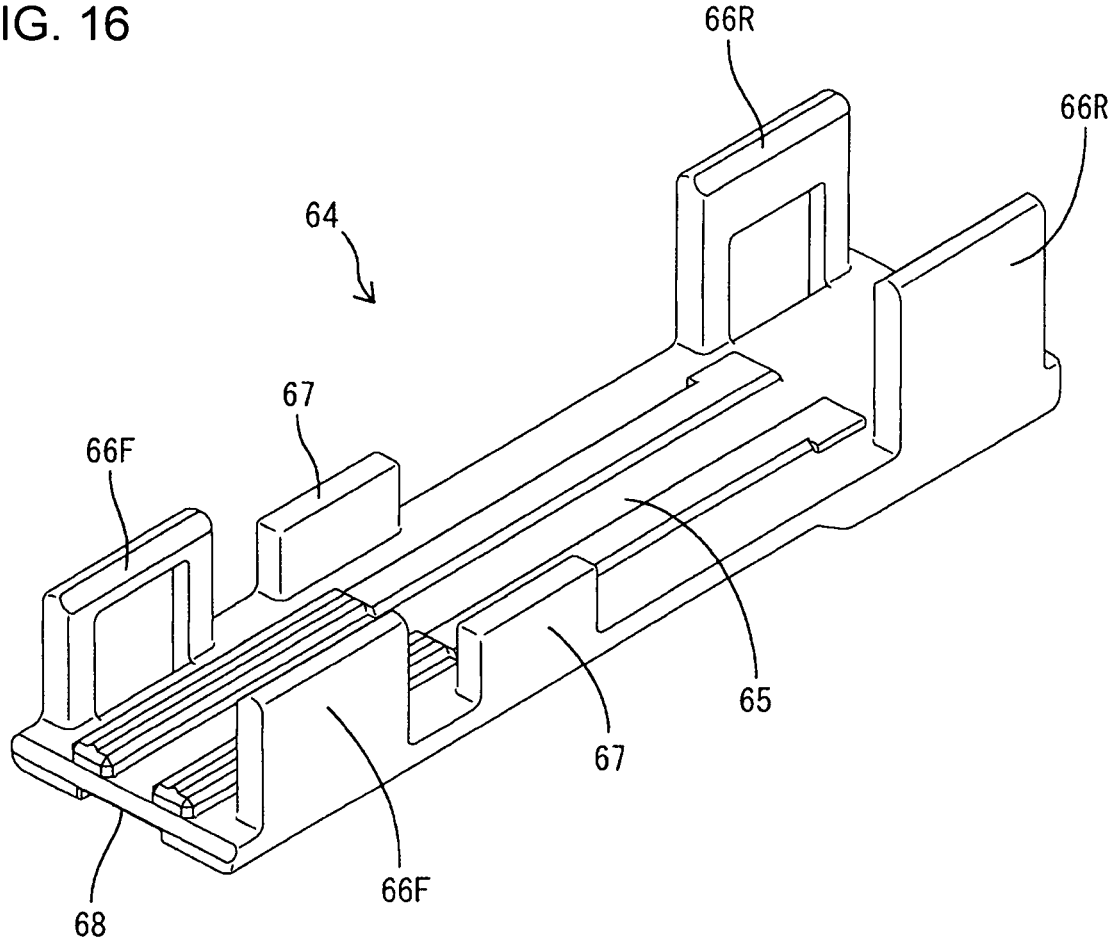
FIG. 16 is a perspective view of a lid member.
Figure 17:
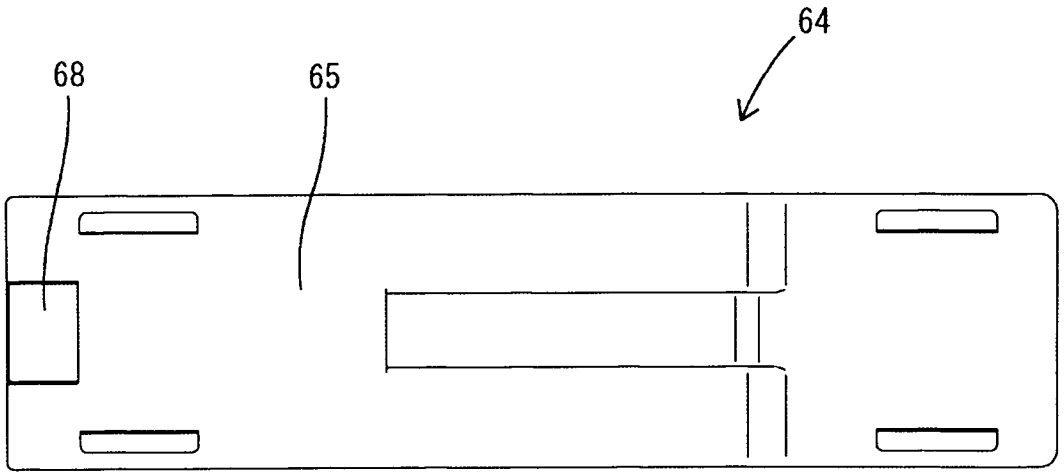
FIG. 17 is a bottom view of the lid member.
Figure 18:
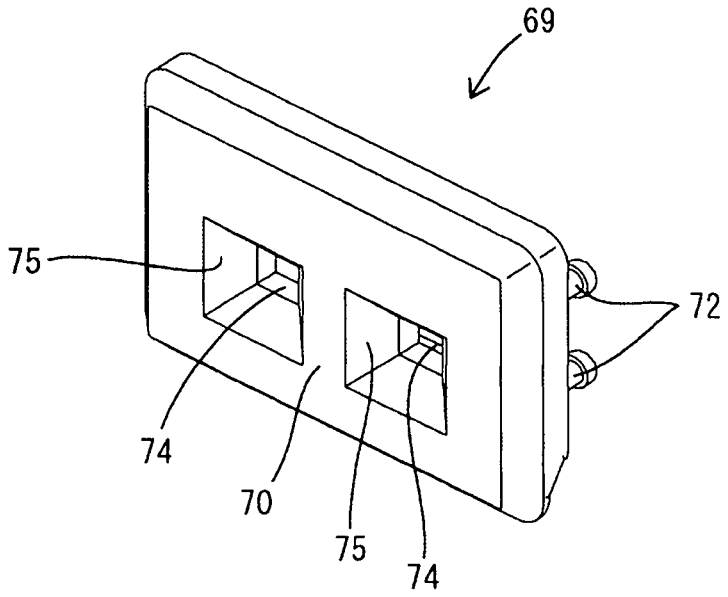
FIG. 18 is a perspective view of a front wall member.
Figure 19:
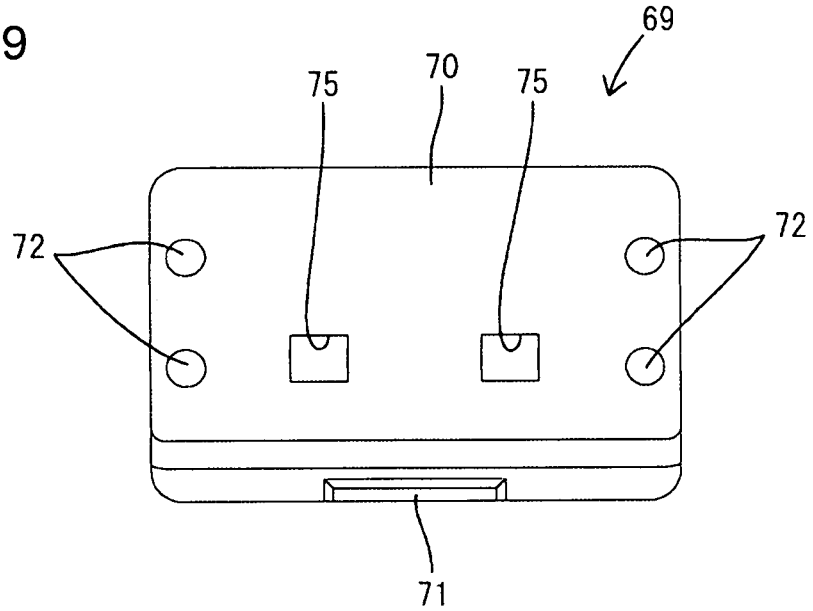
FIG. 19 is a back view of the front wall member.
Figure 20:
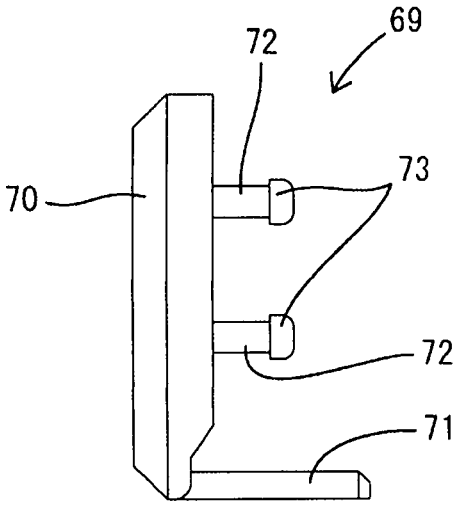
FIG. 20 is a side view of the front wall member.
Figure 21:
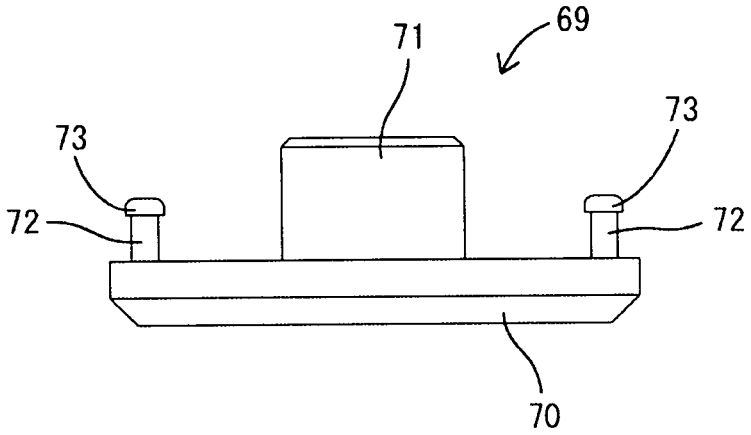
FIG. 21 is a plan view of the front wall member.

As shown in FIGS. 16 and 17, the lid 64 is long and narrow in the front-rear direction. The lid 64 is a single component including a lower wall 65 long in the front-rear direction, two front resilient lock pieces 66F extending up substantially at a right angle from front end parts of both left and right side edges of the lower wall 65 and two rear resilient lock pieces 66R extending up substantially at a right angle from rear end parts of the left and right side edges of the lower wall 65. Left and right positioning protrusions 67 are formed on the both left and right side edges of the lower wall 65 at positions between the front and rear resilient lock pieces 66F, 66R. A pressure receiving portion 68 is formed by shallowly recessing a laterally central part of an outer surface (lower surface) of a front end part of the lower wall 65.

The lid 64 is assembled with the holding member 52 in such a state as to close the lower surface (surface in which the grooves 56 are open over the entire length areas from the front ends to the rear ends) of the holding member 52. In an assembled state, the lower wall 65 is in contact with the lower end surfaces of the left and right side walls 54 and the lower end surface of the separation wall 55 to position the holding member 52 and the lid 64 vertically. Further, the front lock projections 61F and the front resilient lock pieces 66F are locked and the rear lock projections 61R and the rear resilient lock pieces 66R are locked to restrict vertical separation and lateral relative displacements of the holding member 52 and the lid 64. Further, the positioning recesses 62 and the positioning protrusions 67 are fit to restrict relative displacements of the holding member 52 and the lid 64 in the front-rear direction.

In the above way, the holding member 52 and the lid 64 are held in a state vertically united and mounted. By uniting the holding member 52 and the lid 64, the conductor accommodation chambers 57 are formed by the grooves 56 and the lower wall 65 inside the body member 51. In other words, each conductor accommodation chamber 57 is a space enclosed by the upper wall 53, one side wall 54, the separation wall 55 and the lower wall 65. Further, the two conductor accommodation chambers 57 are partitioned in an insulated state by the separation wall 55. The front end of the conductor accommodation chamber 57 is open in the front surface of the body 51 and the rear end thereof is open in the rear surface of the body 51.

The front wall 69 is a single component including a wall body 70 and a pressing portion 71. The pressing portion 71 is in the form of a plate cantilevered rearward substantially at a right angle from a laterally central part of a lower end edge of the wall body 70. A pair of upper and lower fitting projections 72 (fitting portions as claimed) cantilevered rearward are formed on each of both left and right end parts of the rear surface of the wall body portion 70. A diameter enlarged portion 73 is formed on a projecting end part (rear end part) of each fitting projection 72.

Left and right tab insertion openings 74 penetrate through the wall body 70 in the front-rear direction (wall thickness direction of the wall body 70) and have square cross-sections. Elongated tabs 84 on tips of mating inner conductors 83 are inserted into the tab insertion openings 74. Left and right guiding surfaces 75 are formed in the front surface of the wall body 70. Each guiding surface 75 is formed by tapering a square frame-like area along an edge part of each tab insertion opening 74 in the front surface of the wall body 70. A tab 84 that contacts the guiding surface 75 is guided into the tab insertion opening 74 by the inclination of the guiding surface 75.

The front wall 69 is mounted on the front surface of the body 51. By assembling the front wall 69 with the body 51, the dielectric 50 is configured. The front wall 69 and the body 51 are locked in an assembled state by press-fitting the fitting projections 72 into the fitting holes 60 and locking the diameter enlarged portions 73 on the tips of the fitting projections 72 to rear edges of the fitting holes 60.

The inner conductor 76 is formed by applying bending and the like to a metal plate material, and is elongated in the front-rear direction. A rectangular tubular conductor body 77 is formed in a front end area of the inner conductor 76, and a crimping portion 78 forms an open barrel in a rear end area of the inner conductor 76. A rear end part of the conductor body 77 is formed with a retaining projection 79 projecting up from the upper surface thereof.

Front end parts of two wires 81 are connected individually and conductively to the two inner conductors 76. In particular, the front part of the wire 81 is crimped conductively and substantially coaxially to each crimping portion 78. The two wires 81 constitute a twisted pair cable 80 by being spirally twisted each other. The twisted pair cable 80 is integrated while being collectively enclosed by a tubular insulating member 82 and constitutes a signal circuit.

Each inner conductor 76 is accommodated into the conductor accommodation chamber 57. The inner conductor 76 accommodated in the conductor accommodation chamber 57 is in contact with the upper wall 53, the lower wall 65, the side wall 54 and the separation wall 55, thereby being held with relative displacements in the vertical and lateral directions restricted with respect to the conductor accommodation chamber 57 (dielectric 50). Further, the fitting of the retaining projection 79 and the retaining recess 58 holds the inner conductor 76 with relative displacements in the front-rear direction restricted with respect to the conductor accommodation chamber 57 (dielectric 50).

The dielectric 50 is configured by assembling three components, i.e. the holding member 52, the lid 64 and the front wall 69. Polypropylene (PP) is used as a material of the holding member 52. A material of the lid 64 is also polypropylene. That is, the holding member 52 and the lid 64 constituting the body member 51 are made of the same material. On the other hand, polybutylene terephthalate (PBT), which is synthetic resin having a relatively high mechanical strength, is used as a material of the front wall 69 constituting a front surface part of the dielectric 50.

Polybutylene as the material of the body member 51 has a lower mechanical strength and a lower dielectric constant (relative dielectric constant) than polypropylene terephthalate. In selecting the material of the body 51, it is considered that the inner conductors 76 constitute the signal circuit and the holding member 52 is formed integrally with the separation wall 55 partitioning between the two inner conductors 76. Thus, polypropylene, which is synthetic resin less affecting signal transmission, i.e. having a relatively low dielectric constant (relative dielectric constant), is selected as the material of the body 51.

On the other hand, in selecting the material of the front wall 69, a possibility that the tabs 84 are pierced into the guiding surfaces 75 in the front surface of the front wall 69 due to tolerances and the like is considered since the elongated tabs 84 of the mating inner conductors 83 are inserted into the tab insertion openings 74 from the front of the dielectric 50. Thus, polybutylene having such a mechanical strength as not to be pierced by the tabs 84 is selected as the material of the front wall 69.

Next, an assembling procedure of the connector 2 of the second embodiment is described. The front end part of the wire 81 is crimped to the rear end part of each inner conductor 76. The two inner conductors 76 having the wires 81 crimped thereto are set in the vertically inverted holding member 52 and individually accommodated into the grooves 56. With the inner conductors 76 properly accommodated in the grooves 56, the retaining projections 79 are locked to the retaining recesses 58. Thus, the inner conductors 76 are held with displacements in the front-rear direction restricted with respect to the holding member 52 (groove portions 56).

A mounting direction of each inner conductor 76 into the groove 56 is substantially at a right angle to axial directions of the inner conductor 76 and the wire 81 (front-rear direction). Thus, a length of an area of the front end part of each of the two wires 81 exposed from the front end of the insulating member 82 and untwisted part can be shorter as compared to the case where the inner conductors 76 are inserted into the grooves 56 (conductor accommodation chambers 57) from behind. Thus, an electromagnetic shielding function as the twisted pair cable 80 is excellent.

Thereafter, the lid 64 is brought vertically closer to the holding member 52 and united. With the holding member 52 and the lid 64 united, the front resilient lock pieces 66F and the front lock projections 61F are locked, the rear resilient lock pieces 66R and the rear lock projections 61R are locked and the positioning recesses 62 and the positioning protrusions 67 are locked to hold the holding member 52 and the lid 64 in a united state. In the united state, the two inner conductors 76 are held accommodated in the conductor accommodation chambers 57.

After the holding member 52 and the lid 64 are united, the front wall 69 is mounted on the body 51 by bringing the front wall 69 brought closer to the body 51 from the front and the rear surface of the wall body 70 is brought into contact with the front surface of the body 51. At this time, the fitting projections 72 of the front wall 69 are fit into the fitting holes 60 of the body 51 and the diameter enlarged portions 73 of the fitting projections 72 are locked to the body 51. In the above way, the front wall 69 is assembled properly assembled with the body 51.

Further, with the lid 64 mounted on the body 51, the wall body 70 of the lid 64 is held mounted by being press-fit to the holding member 52, and the pressing portion 71 is in surface contact with the pressure receiving portion 68 of the lid 64 from below. By this contact of the pressing portion 71, a downward displacement of the front part of the lid 64 in a direction to be separated from the holding member 52 is restricted. In the above way, the two inner conductors 76 are accommodated in the dielectric 50 at the same time as the assembling of the dielectric 50 is completed. The dielectric 50 having the inner conductors 76 mounted therein is inserted into the housing 85 and locked in a retained state by locking the locking projection 63 to locking lances 86.

The connector 2 of the second embodiment is designed for the purpose of combining an improvement of communication performance and a reliability improvement of a connecting operation, and includes the dielectric 50 and the inner conductors 76. The dielectric 50 includes two conductor accommodation chambers 57 laterally partitioned by the separation wall 55, and the two inner conductors 76 are individually accommodated into the two conductor accommodation chambers 57.

The dielectric 50 includes the body 51 made of synthetic resin. The body 51 is formed with the separation wall 55 and the two conductor accommodation chambers 57. The front wall 69 is made of synthetic resin and is mounted on the front of the body 51 to close front openings of the conductor accommodation chambers 57. The front wall 69 is formed with the tab insertion openings 74 allowing the tabs 84 of the mating inner conductors 83 to be inserted into the conductor accommodation chambers 57 from the front of the dielectric 50.

The separation wall 55 is made of the synthetic resin material (polypropylene) having a lower dielectric constant than the front wall 69. The front wall 69 is made of the material (polybutylene terephthalate) having a higher mechanical strength than the separation wall 55. In the connector 2 of the second embodiment, the separation wall 55 interposed between the two inner conductors 76 is made of the material having a relatively low dielectric constant. Thus, the communication performance of electrical signals passing through the inner conductors 76 is guaranteed. Further, since the front wall 69 is made of the material having a higher mechanical strength than the separation wall 55, even if the tabs 84 of the mating inner conductors 83 interfere with the front wall 69, there is no possibility that the tabs 84 are pierced into the front wall member 69.

Further, the two wires 81 connected to the rear end parts of the inner conductors 76 constitute the twisted pair cable 80. If the inner conductors 76 connected to the respective wires 81 were inserted into the conductor accommodation chambers 57 from behind, the body member 51, untwisted lengths of the wires 81 need to be increased. However, in the second embodiment, the dielectric 50 is divided into the holding member 52 and the lid 64, and the holding member 52 is formed with the separation wall 55 and the two grooves 56 constituting the two conductor accommodation chambers 57.

The lid 64 is mounted on the holding member 52 to close openings of the two grooves 56. According to this configuration, it is not necessary to insert the two inner conductors 76 into the conductor accommodation chambers 57 from behind the dielectric 50. Thus, the untwisted lengths of the wires 81 can be shortened and, consequently, a reliability reduction of the shielding function of the twisted pair cable 80 can be avoided.

Further, the front wall 69 and the holding member 52 are formed with the fitting portions (fitting projections 72 and fitting holes 60) for holding the front wall 69 and the holding member 52 in the assembled state by being fit to each other. The front wall 69 has the pressing portion 71 for holding the lid 64 assembled with the holding member 52 by being held in contact with the outer surface of the lid 64 when the lid 60 is assembled with the holding member 52. Accordingly, the lid 64 and the holding member 52 are held reliably in the assembled state.

The invention is not limited to the above described and illustrated embodiments. For example, the following embodiments also are included in the scope of the invention.

Although the holding member is a component made of the single material in the above first and second embodiments, the holding member may be a single component formed by making the separation wall and parts other than the separation wall of different materials and integrating the separation wall and the other parts by two-color molding.

Although the separation wall is formed integrally to the holding member in the first and second embodiments, the separation wall may be a component separate from the holding member.

Although two inner conductors are accommodated into one dielectric in the first and second embodiments, one, three or more inner conductors may be accommodated into one dielectric.

Although the body is composed of two components, i.e. the holding member and the lid, in the first and second embodiments, the body may be a single component.

Although the wires connected to the inner conductors constitute the twisted pair cable in the above first and second embodiments, the invention can also be applied to a case where the wires connected to the inner conductors do not constitute the twisted pair cable.

Although the separation wall(holding member) is made of polypropylene (PP) in the first and second embodiments, the separation wall (holding member) may be made of polyethylene (PE), polystyrene (PS), foamed polybutylene terephthalate or the like.

Although the front wall is made of polybutylene terephthalate (PBT) in the first and second embodiments, the front wall may be made of a material other than polybutylene terephthalate.

Although a combination of the materials of the front wall and the separation wall is a combination of polybutylene terephthalate and polypropylene in the first and second embodiments, this combination may be a combination of polybutylene terephthalate and polyethylene (PE) or a combination of polybutylene terephthalate and foamed polybutylene terephthalate.

LIST OF REFERENCE SIGNS

1, 2 . . . connector
10, 50 . . . dielectric
11, 51 . . . body
12, 52 . . . holding member
15, 55 . . . separation wall
16, 56 . . . groove
17, 57 . . . conductor accommodation chamber
20, 60 . . . fitting hole (fitting portion)
24, 64 . . . lid
28, 69 . . . front wall
30 . . . positioning portion
31, 72 . . . fitting projection (fitting portion)
33 . . . tab insertion opening
36 . . . inner conductor
46 . . . mating inner conductor
47 . . . tab
71 . . . pressing portion

The invention claimed is:

1. An electrical connector, comprising:

a dielectric including conductor accommodation chambers laterally partitioned by a separation wall;

inner conductors individually accommodated in the conductor accommodation chambers;

a body made of synthetic resin, the body constituting part of the dielectric and formed with the separation wall and the conductor accommodation chambers;

a front wall made of synthetic resin, the front wall constituting part of the dielectric and mounted on a front part of the body to close front openings of the conductor accommodation chambers, the front wall formed with a concave positioning portion projecting rearward from a rear surface of the front wall for positioning and holding the inner conductors by receiving front end parts of the inner conductors therein; and tab insertion openings formed in the front wall and allowing tabs of mating inner conductors to be inserted into the conductor accommodation chambers from a front of the dielectric, the separation wall being made of a material having a lower dielectric constant than the front wall; and the front wall being made of a material having a higher mechanical strength than the separation wall.

2. The electrical connector of claim 1, wherein the dielectric includes:

a holding member formed with the separation wall and grooves constituting the conductor accommodation chambers; and a lid mounted on the holding member to close openings of the grooves.

3. The electrical connector of claim 2, wherein:

the front wall and the holding member are formed with fitting portions for holding the front wall and the holding member in an assembled state by being fit to each other; and the front wall is formed with a pressing portion for holding the lid in a state assembled with the holding member by being held in contact with the lid with the front wall assembled with the holding member.

4. An electrical connector, comprising:

a dielectric including a holding member having an upper wall and at least one separation wall projecting therefrom to laterally partition grooves, a lid connected to the holding member and having a lower wall facing the upper wall of the holding member to define conductor accommodation chambers laterally partitioned by the separation wall, the holding member and the lid formed from a first synthetic resin, and a front wall formed of a second synthetic resin mounted on a front part of the holding member to close front openings of the conductor accommodation chambers, tab insertion openings formed in the front wall and allowing tabs of mating inner conductors to be inserted into the conductor accommodation chambers from a front of the dielectric; and inner conductors individually accommodated in the conductor accommodation chambers; wherein the first synthetic resin has a lower dielectric constant than the second synthetic resin, the second synthetic resin has a higher mechanical strength than the first synthetic resin, the front wall and the holding member are formed with fitting portions for holding the front wall and the holding member in an assembled state by being fit to each other; and the front wall is formed with a pressing portion for holding the lid in a state assembled with the holding member by being held in contact with the lid with the front wall assembled with the holding member.

5. An electrical connector, comprising:

a dielectric comprising:

a holding member including an upper wall, first and second side walls projecting from the upper wall and extending in a connection direction, and at least one separation wall projecting from the upper wall between the first and second side walls and parallel thereto, the holding member formed of a first material;

a lid formed of the first material fit to the holding member, the lid having a lower wall facing the upper wall of the holding member and in contact with lower edges of the first and second side walls and the at least one separation wall to define conductor accommodation chambers laterally partitioned by the first and second side walls and the separation wall; and a front wall mounted on a front part of the holding member, tab insertion openings formed in the front wall, and positioning portions projecting rearwardfrom a rear surface of the front wall and communicating with the tap insertion openings and for receiving front ends of inner conductors, the front wall being formed of a second material different from the first material; and inner conductors having front ends held individually in the positioning portions, the inner conductors inserted into the conductor accommodating chambers from the front and held in contact with the upper wall of the holding member, the lower wall of the lid, one of the first and second side walls, and the separation wall; wherein the first material forming the holding member and the lid has a lower dielectric constant than the second material forming the front wall; and the second material forming the front wall has a higher mechanical strength than the first material.

* * * * *